United States Patent [19]

Kondo

[11] Patent Number: 4,994,816

[45] Date of Patent: Feb. 19, 1991

[54] PORTABLE ANTENNA APPARATUS

[75] Inventor: Haruto Kondo, Yokohama, Japan

[73] Assignee: Kabushiki Kaisha Toshiba, Kawasaki, Japan

[21] Appl. No.: 334,552

[22] Filed: Apr. 7, 1989

[30] Foreign Application Priority Data

| | | | |
|---|---|---|---|
| Apr. 8, 1988 | [JP] | Japan | 63-86613 |
| Apr. 8, 1988 | [JP] | Japan | 63-86614 |
| Apr. 8, 1988 | [JP] | Japan | 63-86615 |
| Apr. 8, 1988 | [JP] | Japan | 63-86616 |

[51] Int. Cl.[5] ..... H01Q 1/12; H01Q 15/16

[52] U.S. Cl. ..... 343/762; 343/881; 343/882; 343/916

[58] Field of Search ..... 343/880-882, 343/872, 915, 916, 840, 765, 757, 762, 878, 781 R, 912

[56] References Cited

U.S. PATENT DOCUMENTS

| | | | |
|---|---|---|---|
| 3,263,232 | 7/1966 | Burwell et al. | 343/916 |
| 4,086,599 | 4/1978 | VanderLinden et al. | 343/882 |
| 4,185,288 | 1/1980 | Dosch et al. | 343/882 |
| 4,232,320 | 11/1980 | Savalle et al. | 343/882 |
| 4,404,565 | 9/1983 | Gurney et al. | 343/881 |
| 4,458,251 | 7/1984 | Bondon | 343/916 |
| 4,771,293 | 9/1988 | Williams et al. | 343/881 |

FOREIGN PATENT DOCUMENTS

| | | | |
|---|---|---|---|
| 57002 | 8/1982 | European Pat. Off. | 343/883 |
| 0293877 | 12/1988 | European Pat. Off. . | |
| 1179459 | 9/1985 | U.S.S.R. | 343/882 |

OTHER PUBLICATIONS

British Aerospace Dynamics Group Bristol Division, "Antenna Systems for Transportable Satellite Ground Stations", Aug. 1982, Bristol, England.

*Primary Examiner*—Michael C. Wimer

*Attorney, Agent, or Firm*—Oblon, Spivak, McClelland, Maier & Neustadt

[57] ABSTRACT

A portable antenna apparatus comprises a foldable leg unit. This leg unit is provided with at least three legs each having a first jack, and a mount whose angle of rotation is adjustable. A foldable support unit, which has a plurality of beam members combined to provide a substantially box-like shape, is coupled to the mount. A foldable arm unit is coupled to the support unit. The arm unit is provided with a reflector-mounting member having extension mechanism, an arm hinged to the reflector-mounting member, and a primary horn mount attached to the arm. A reflector made up of a plurality of divisions is attached to the reflector-mounting member of the arm unit, and a primary horn is attached to the primary horn mount of the arm unit.

12 Claims, 15 Drawing Sheets

PORTABLE ANTENNA APPARATUS

BACKGROUND OF THE INVENTION

1. Field of the Invention

The present invention relates to a portable antenna apparatus which is used as a mobile terrestrial station of satellite communication such as satellite broadcasting.

2. Description of the Related Art

Among antenna apparatuses comprising reflectors which meet the antenna standards determined for satellite communication, a type which is mounted on a vehicle is in general use.

However, this type of portable antenna apparatus cannot be used in places into which the vehicle cannot go, so that it cannot be used in every desirable place.

In the meantime, the diameter of the reflector of a conventional portable antenna apparatus should be smaller than 1.2 m, so as to permit the antenna apparatus to be carried by a man. With such a small-sized diameter, however, the antenna apparatus does not meet the U.S. FCC Standard (which is generally regarded as one of the strictest antenna standards) and is not very reliable.

Since a reflector having a diameter of 1.8 m or more meets the U.S. FCC Standard, it may be thought to provide such a large-diameter reflector for a portable antenna apparatus originally adapted for a 1.2 m-reflector. However, if the support unit and leg unit are modified in a manner to support the large-diameter reflector, the entire construction will become complex. In addition, the number of packages necessary for storing the disassembled parts of the antenna apparatus will inevitably increase, so that the antenna apparatus will become difficult to handle.

In summary, a portable antenna apparatus is required to satisfy the following points: it should comprise a reflector meeting the various antenna standards, such as the U.S. FCC Standard; it should be easily carried; it should not require a large number of packages for storing disassembled parts; and it should be designed to achieve easy folding and expansion. In addition to these points, the portable antenna apparatus should be made up of parts satisfying the International Flight Package Standard indicated below, so as to permit the disassembled parts to be carried easily:

Size of Part (incl. Casing):

(Length) + (Width) + (Height) ≦ 80 inches (=2.032 Kg)
Weight of Part (incl. Casing) ≦ 100 pounds (=45.359 Kg)

SUMMARY OF THE INVENTION

Accordingly, an object of the present invention is to provide a portable antenna apparatus which comprises a reflector meeting various antenna standards, is made up of parts each satisfying the International Flight Package Standard, and is made easy to handle by reducing the number of packages for storing the parts.

To achieve this object, the portable antenna apparatus of the present invention comprises: a foldable leg unit including at least three legs each having a first jack, and a rotatable mount whose angle of rotation is adjustable; a foldable support unit coupled to the mount and including a plurality of beam members combined to have a box-like shape; and a foldable arm unit coupled to the support unit and including a reflector mounting member with extension mechanism, an arm hinging at the reflector mounting member, and a primary horn mount attached to the arm. A reflector made up of a plurality of divisions is attached to the reflector mounting member of the arm unit, and a primary horn is attached to the primary horn mount of the arm unit.

The portable antenna apparatus of the invention can be divided into the leg unit, support unit, arm unit, reflector, and primary horn, so that the number of storage packages can be reduced to the minimum. In addition, the size and weight of each division or part satisfies the International Flight Package Standard, so that the antenna apparatus can be easily carried and the assembling and disassembling operations of the antenna apparatus are easy to perform.

Further, the reflector of the antenna apparatus meets various antenna standards, including the U.S. FCC Standard.

DETAILED DESCRIPTION OF THE PREFERRED EMBODIMENTS

An embodiment of the invention may now be described in detail, with reference to the accompanying drawings.

Figure 1:
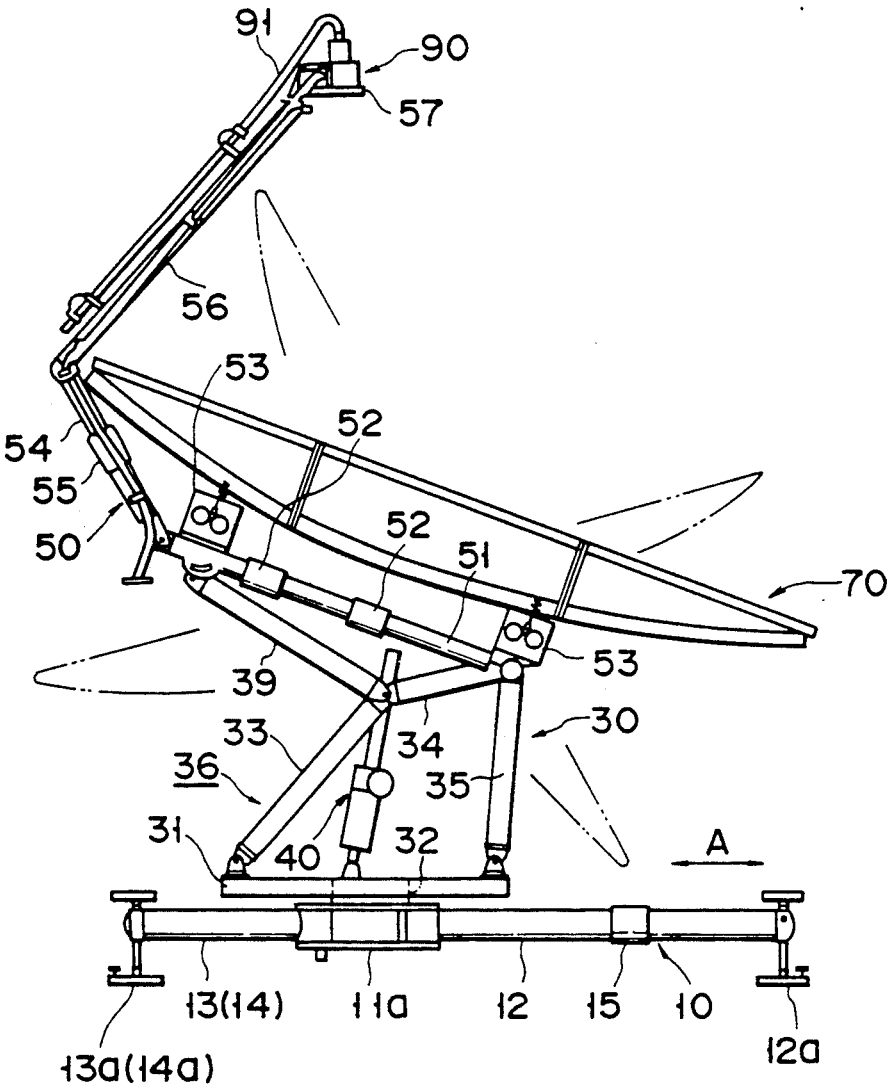
FIG. 1 is a side view of the portable antenna apparatus according to one embodiment of the present invention.
Figure 2:
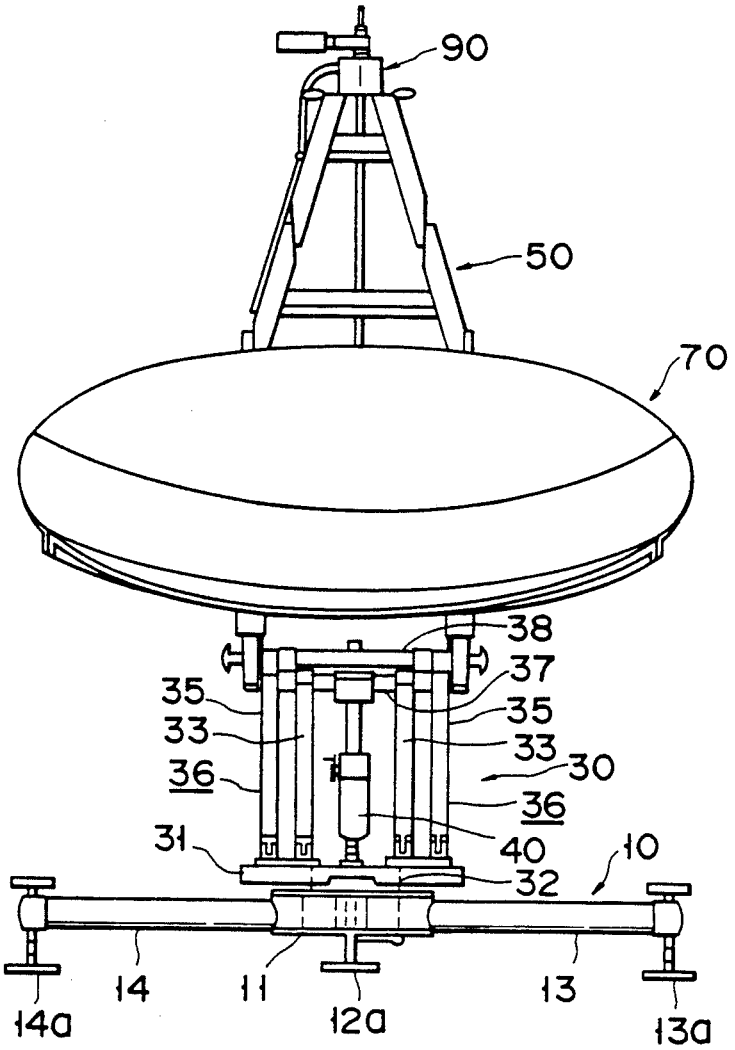
FIG. 2 is a front view of the antenna apparatus.
Figure 3:
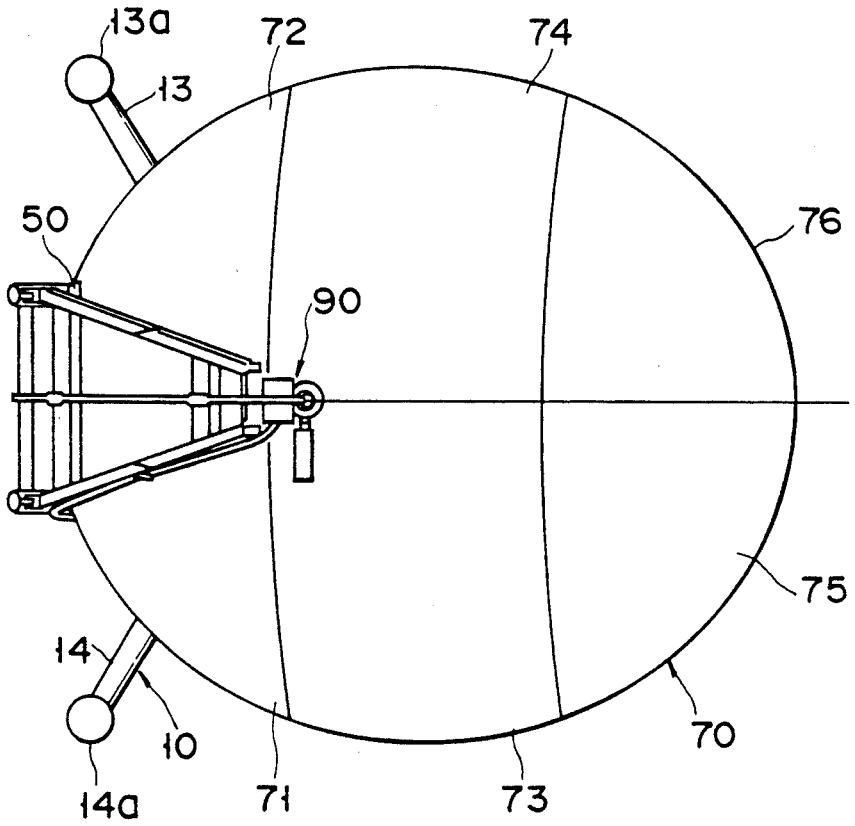
FIG. 3 is a plan view of the antenna apparatus.

FIGS. 1 through 3 show the portable antenna apparatus according to one embodiment of the present invention. The antenna apparatus comprises, and can be disassembled into, leg unit 10, support unit 30, arm unit 50, reflector 70, and primary horn 90.

Figure 4:
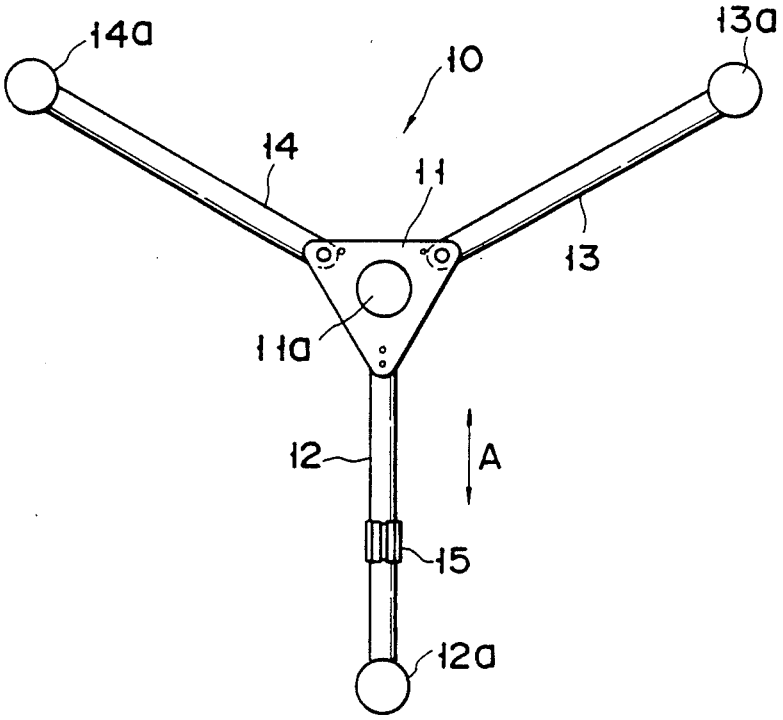
FIG. 4 is a plan view of the leg unit employed in the antenna apparatus.
Figure 5:
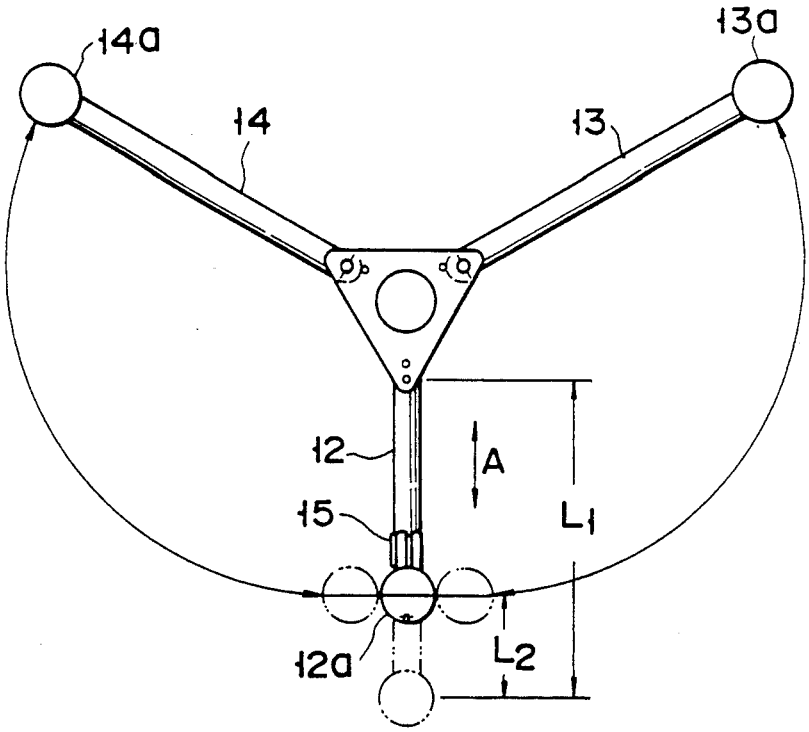
FIGS. 5 and 6 are plan views illustrating the operation of the leg unit.
Figure 6:
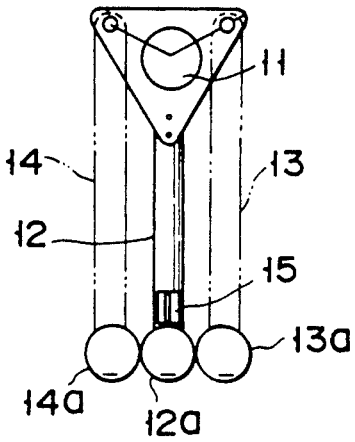

As is shown in FIG. 4, leg unit 10 comprises substantially triangular main body 11 having rotatable mount **11*a*** in the substantially central portion thereof. First leg 12 is fixed to one of the three apexes of triangular main body 11, and second and third legs 13 and 14 are pivotally connected to the respective remaining apexes. Jacks 12*a*–14*a*, used for adjusting the level or height of the antenna apparatus, are attached to the tip ends of legs 12–14, respectively. First leg 12 has extension mechanism 15, by means of which leg 12 can be lengthened or shortened in the axial direction thereof, i.e., in direction A indicated by the arrow in FIG. 4. Since second and third legs 13 and 14 are pivotally connected to reference to main body 11, leg unit 10 can be folded by pivoting second and third legs 13 and 14 to first leg 12. FIGS. 5 and 6 illustrate how leg unit 10 is folded for keeping or expanded for use. To fold leg unit 10, second and third legs 13 and 14 are pivoted with reference to main body 11 toward first leg, and first leg 12 is shortened such that three jacks 12*a*–14*a* are aligned. To expand leg unit 10, second and third legs 13 and 14 are pivoted away from first leg 12, and first leg 12 is lengthened until it becomes substantially as long as second and third legs 13 and 14.

Figure 7:
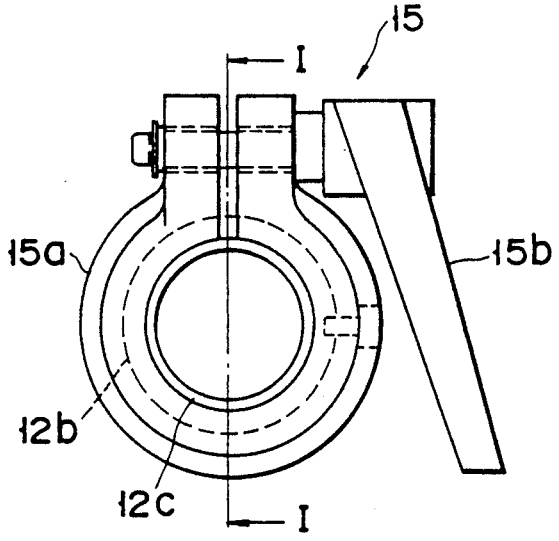
FIG. 7 is a plan view of the expansion means attached to the legs of the leg unit.
Figure 8:
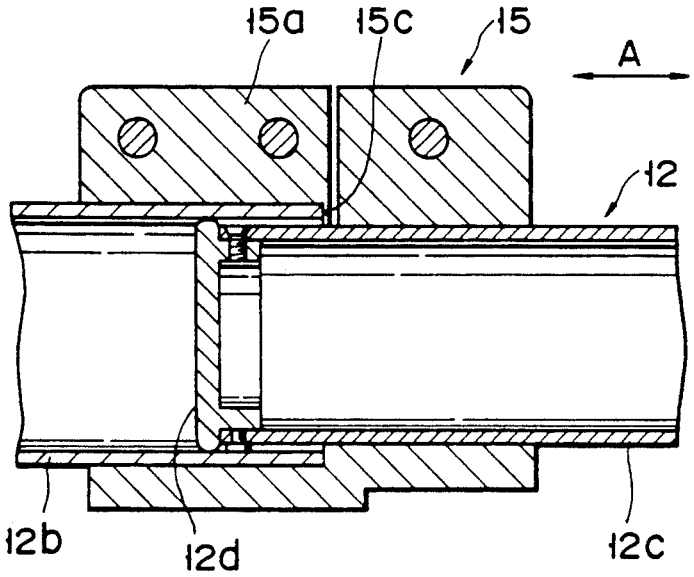
FIG. 8 is a sectional view taken along line I—I in FIG. 7.

As is shown in FIGS. 7 and 8, extension mechanism 15 of first leg 12 includes outer cylinder 12*b* located inside of main body 11, and inner cylinder 12*c*having jack 12*a* at the tip end thereof. Inner cylinder 12*c* is slidable with reference to outer cylinder 12*b* in the axial direction of extension mechanism 15, i.e., in direction A indicated by the arrow in FIG. 1. Clamp member 15*a* for locking is provided at the tip end of outer cylinder 12*b*. Clamp member 15*a* includes a ratchet type operating lever 15*b*. Since inner cylinder 12*c* is locked or unlocked with reference to outer cylinder 12*b* in response to the switching of operating lever 15*b*, first leg 12 can be adjusted to have either length L1 or length (L1–L2), as is shown in FIG. 5.

As is shown in FIGS. 1 and 2, support unit 30 is rotatably coupled to mount 11*a* of leg unit 10. Support unit 30 comprises base 31 and a number of beam members. In substantially the central portion of base 31, fitting portion 32 is provided such that it corresponds in location to mount 11*a* of leg unit 10. A pair of first beam members 33 are pivotally connected to the rear portions of the upper side of base 31. Likewise, a pair of third beam members 35 are pivotally connected to the front portions of the upper side of base 31. First and third beam members 33 and 35 are hinged together by means of second beam member 34. First, second and third beam members 33–35 have different lengths. These beam members and base 31 jointly constitute right and left deformable frames 36, which are symmetric to each other. Fourth beam member 37 extends between right and left deformable frames 36 in a manner to connect first and second beams members 33 and 34 together. Likewise, fifth beam member 38 extends between right and left deformable frames 36 in a manner to connect second and third beam members 34 and 35 together. All these beam members are liked together in such a manner to provide substantially a box-like structure. Support beam member 39 is pivotally connected to each end of fourth beam member 37, and reflector-mounting member 51 is provided between one end of support-member 39 and fifth beam member 38.

Figure 9:
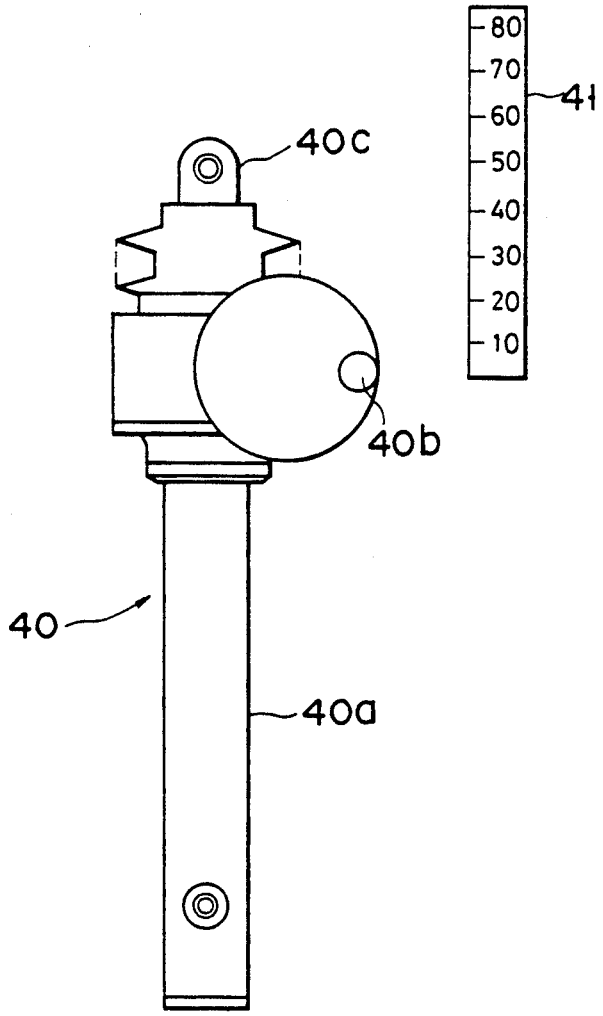
FIG. 9 is a side view of the jack attached to the support unit employed in the antenna apparatus.
Figure 10:
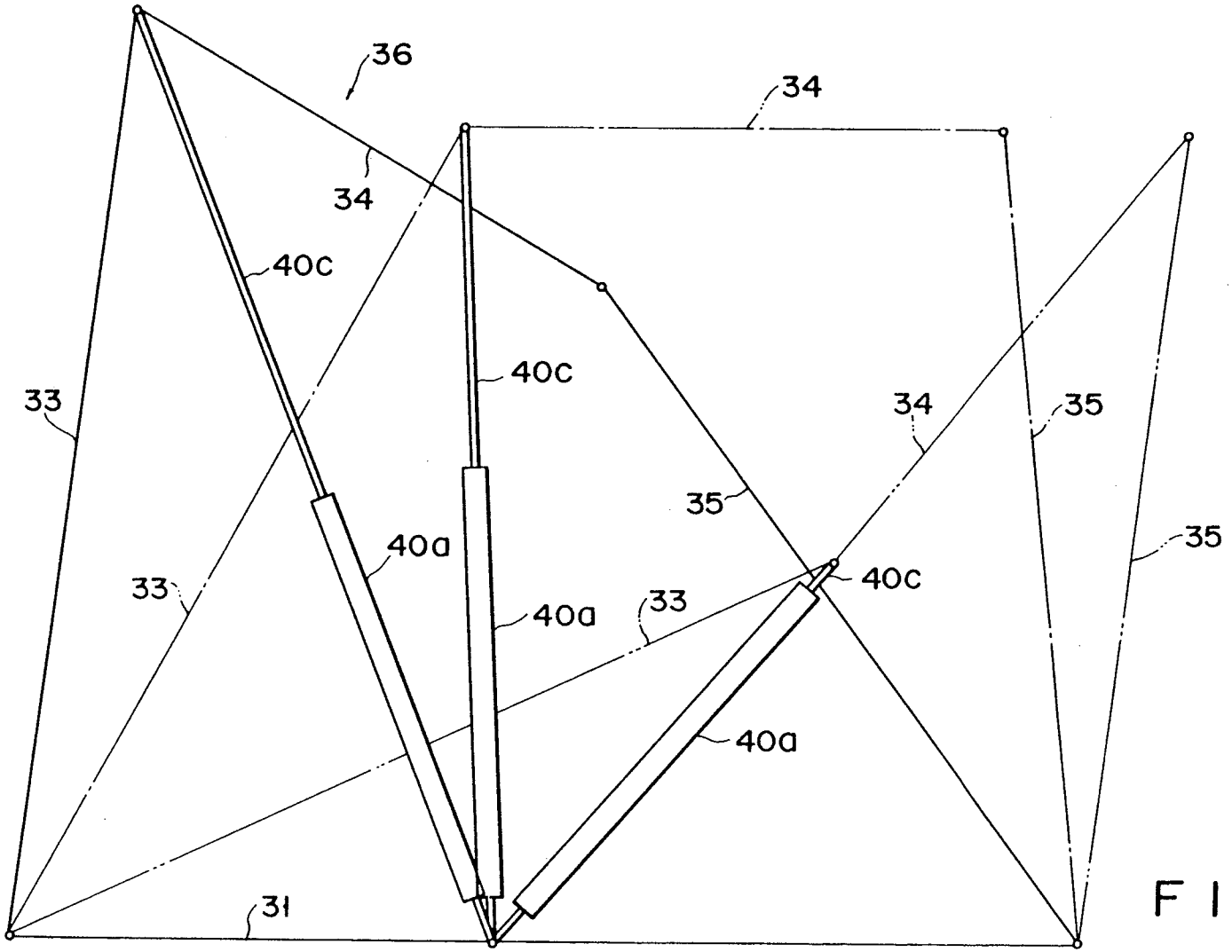
FIG. 10 is a view illustrating the operation of the support unit.
Figure 11:
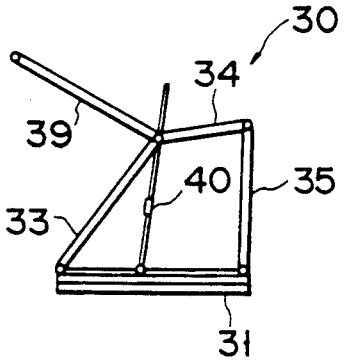
FIGS. 11 through 14 are side views illustrating how the support unit is folded or expanded.
Figure 12:
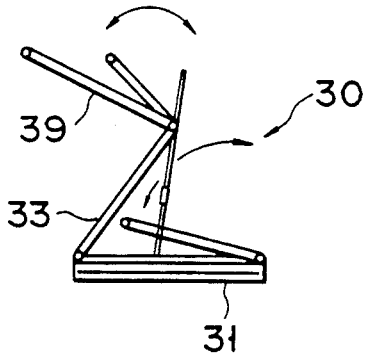
Figure 13:
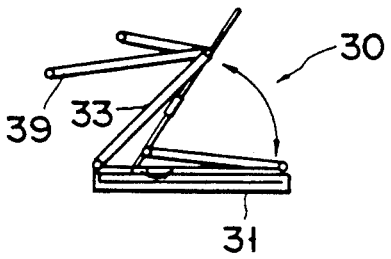
Figure 14:
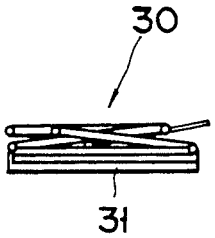
Figure 15:
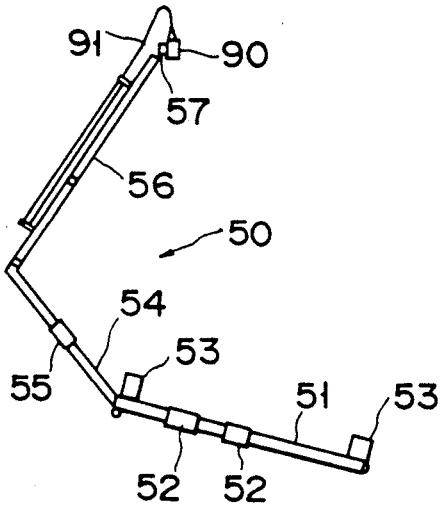
FIGS. 15 through 18 are side views illustrating how the arm unit employed in the antenna apparatus is folded or expanded.
Figure 16:
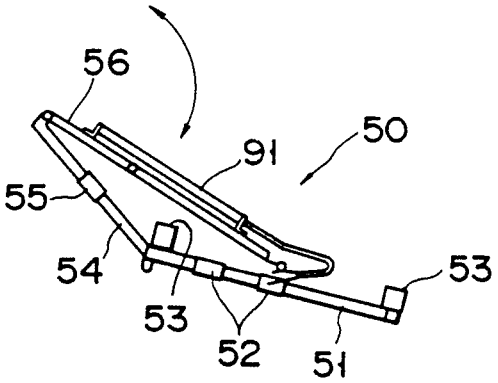
Figure 17:
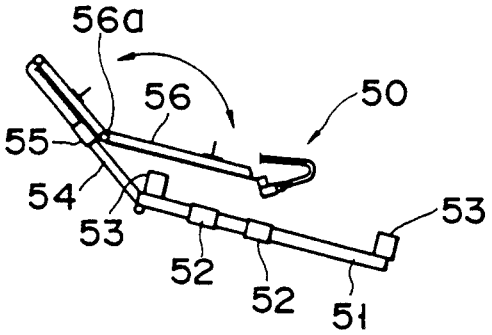
Figure 18:
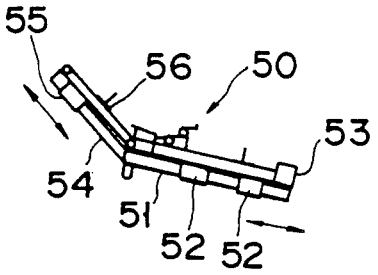

An elevation angle-adjusting device is provided between base 31 and fourth beam member 37. This device comprises jack 40 whose two ends are pivotally connected to base 31 and fourth beam member 37, respectively. As is shown in FIG. 9, jack 40 includes jack main body 40*a*, operating handle 40*b* attached to jack main body 40*a*, and drive shaft 40*c*. Drive shaft 40*c* is axially lengthened or shortened by rotating handle 40*b*. In response to this movement of drive shaft 40*c*, the manner in which first to third beam members 33–35 are coupled together is varied, with the result that each frame 36 is deformed, as is shown in FIG. 10. Due to the deformation of each frame 36, the elevation angle of reflector 70 can be adjusted steplessly within the range of 5° to 80°.

Support unit 30, including deformable frames 36, uses pins for connecting the first to fifth beam members and jack 40 together. Among these pins, at least the pin used for connecting second and third beam members 34 and 35 together and the pin used for connecting the bottom of jack 40 and base 31 are detachable. If such pins are detached, support unit 30 can be folded or expanded, as is shown in FIGS. 11 to 14. That is, support unit 30 can be folded for easy transportation, or expanded for the installation of an antenna.

Arm unit 50 is attached, in a detachable manner, to support unit 30 mentioned above. Arm unit 50 is provided with reflector-mounting member 51 which is removably pivoted between fifth beam member 38 and support member 39, as is shown in FIG. 1. Reflector-mounting member 51 includes two extension mechanisms 52, and two holders 53 attached to the respective ends thereof. Arm unit 50 includes first and second arms 54 and 56. First arm 54 has a first end pivotally connected to reflector-mounting member 51 and a second end hinged to second arm 56, and includes extension mechanism 55 located between the first and second ends. Second arm 56 includes a hinge portion located at an intermediate portion thereof, so that it can be folded in two. Second arm 56 also includes primary horn mount 57 located at the tip end thereof, and primary horn 90 is attached to mount 57 in a detachable manner.

Arm unit 50 can be expanded or folded, as is shown in FIGS. 15–18. To fold arm unit 50, second arm 56 is bent first at its proximal portion and then at its hinge portion, whereby second arm 56 is put on reflector-mounting member 51 and first arm 54. Succeedingly, reflector-mounting member 51 and first arm 54 are shortened by means of their respective extension mechanisms in the manner shown in FIG. 18, whereby the folding of arm unit 50 is completed. To extend this folded arm unit again, the above procedures are performed in the reversed order, i.e., from the state shown in FIG. 18 to the state shown in FIG. 15. Extension mechanisms 52 and 55 is substantially similar to expansion means 15 shown in FIGS. 7 and 8 in their constructions.

Figure 21:
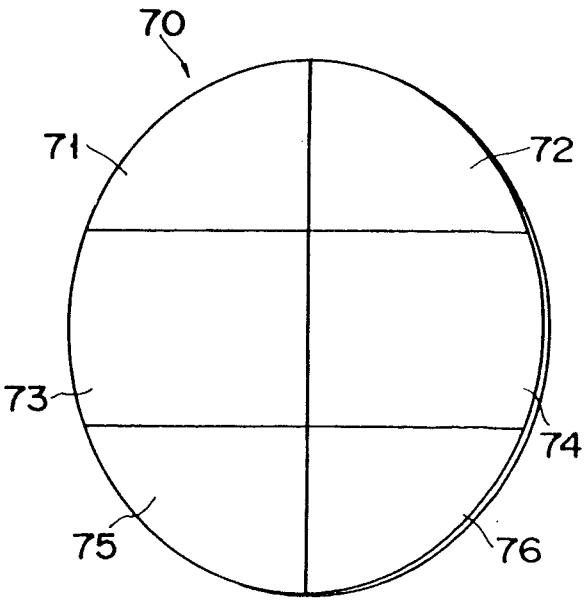
FIGS. 19, 20 and 21 are rear, side and front views, respectively, of the reflector employed in the antenna apparatus.
Figure 20:
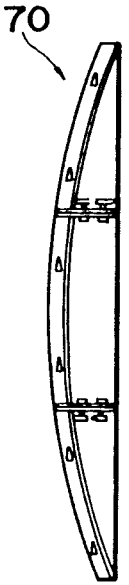
Figure 19:
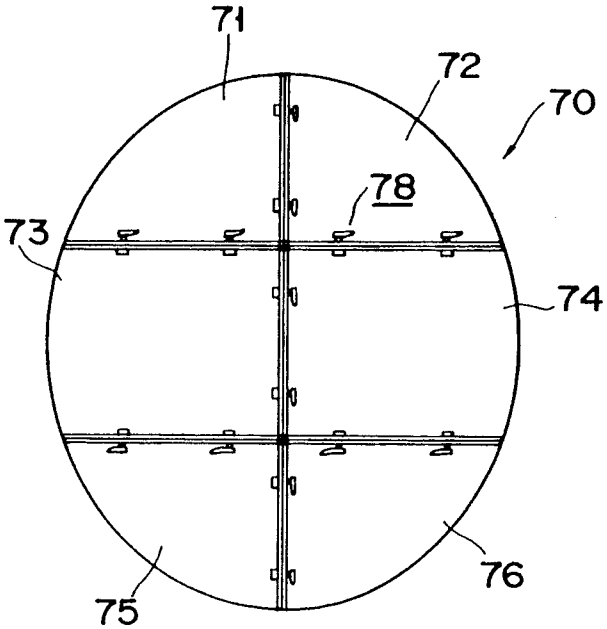
Figure 22:
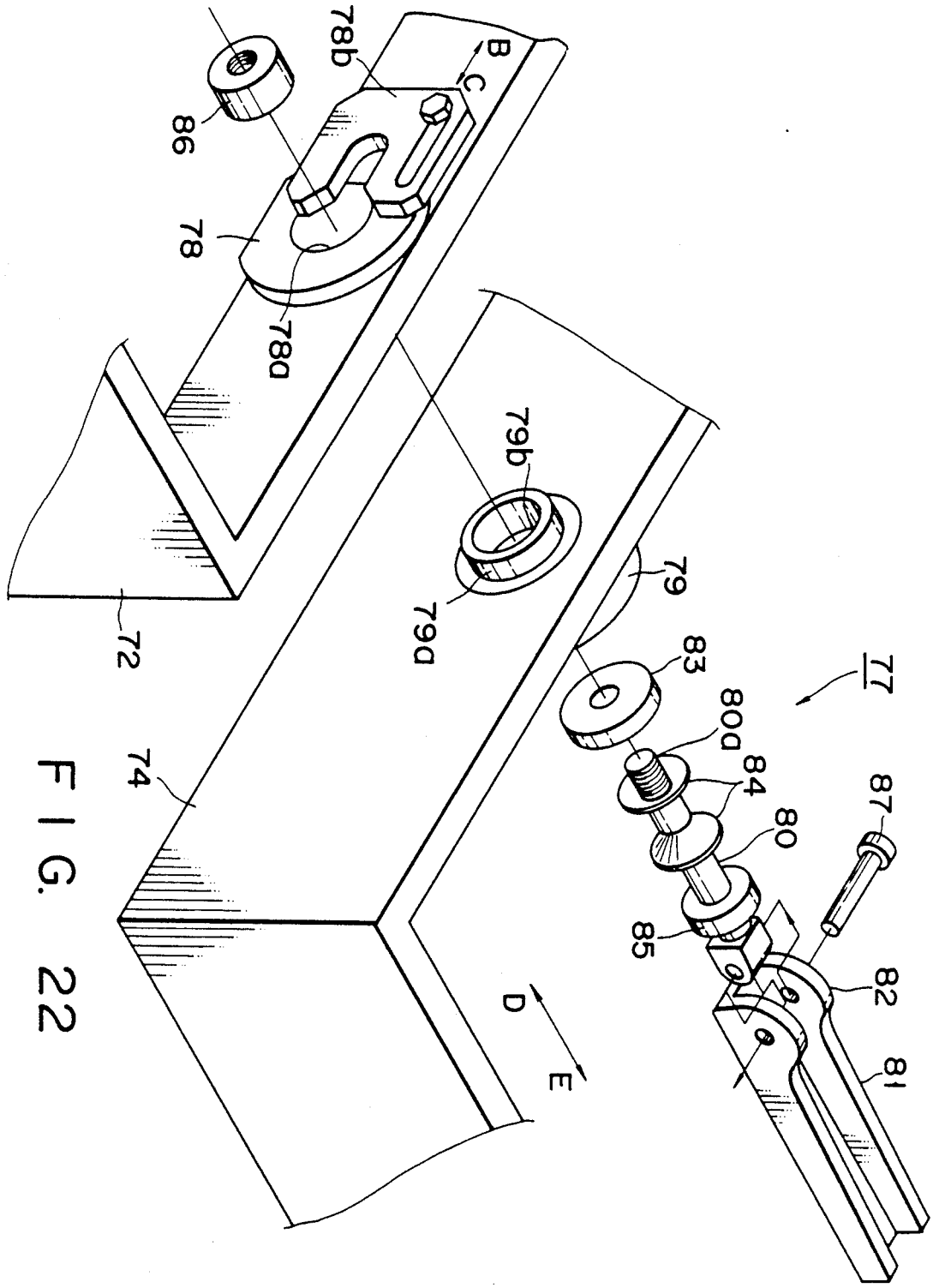
FIG. 22 is an exploded, perspective view of the coupling device of the reflector.
Figure 23:
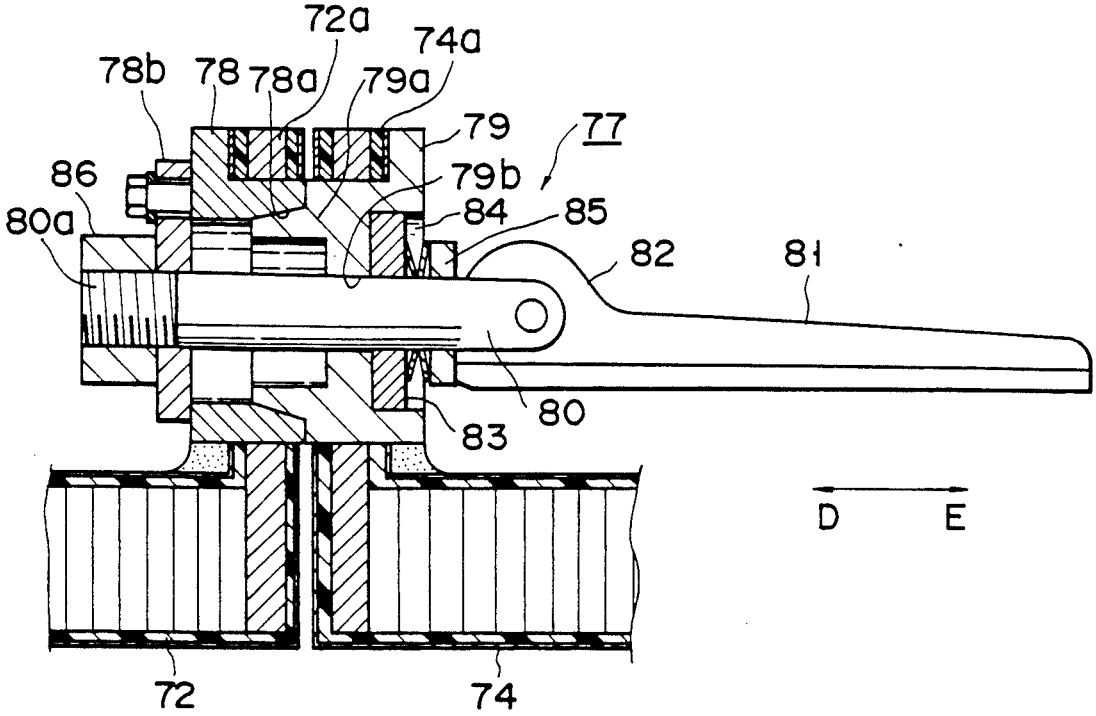
FIG. 23 is a longitudinally sectional view of the coupling device of the reflector.

Reflector 70 will now be described. As is shown in FIGS. 19–21, reflector 70 is made up of e.g. six divisions 71–76. More specifically, reflection 70 has an ellipsoidal shape, and is divisible into six parts (i.e., first to sixth divisions 71–76) along the longer axis of the ellipse and along the two lines perpendicular to the longer axis and dividing it into three substantially equal line segments. First to sixth divisions 71 to 76 are coupled together to provide a reflecting surface, by means of coupling mechanisms 77 substantially similar to one another. As is shown in FIGS. 22 and 23, first to sixth divisions 71–76 has flanges 71*a*–76*a* which are formed along edges where the adjacent divisions are coupled together and which project rearward. A pair of facing flanges are provided with first and second coupling members 78 and 79. First coupling member 78 has fitting hole 78*a* formed therein, and locking member 78*b* located at one side thereof. Locking member 78*b* is slidable in directions B and C indicated by the arrow in FIG. 22, and when it is slid in direction C, the tip end of locking member 78*b* covers part of fitting hole 78*a*. Second coupling member 79 has fitting portion 79*a* in the form of a tapered cylinder, and insertion hole 79*b* formed therein. Fitting portion 79*a* of second coupling member 79 is inserted into fitting hole 78*a* of first coupling member 78, and coupling rod 80 of coupling mechanism 77 is inserted into insertion hole 79*b* of second coupling member 79. Coupling rod 80 has threaded section 80*a* at one end and is hinged, at the other end, to driving cam lever 81 by means of a connecting pin. Cam lever 81 has cam surface 82, and that end portion of cam surface 82 to which coupling rod 80 is perpendicular takes one of first and second positions X and Y in response to the clockwise or counterclockwise rotation of cam lever 81.

After fitting portion 79*a* of second coupling member 79 is inserted into fitting hole 78*a* of first coupling member 78, first washer 85, a pair of initially coned disk springs 84 and second washer 83 are fitted around coupling rod 80 in the order mentioned. Thereafter, coupling rod 80 is inserted first into insertion hole 79*b* of second coupling member 79 and then into fitting hole 78*a* of first coupling member 78. Next, nut 86 is threadably fitted around section 80*a* of rod 80 until it engages locking member 78*b*.

Figure 24:
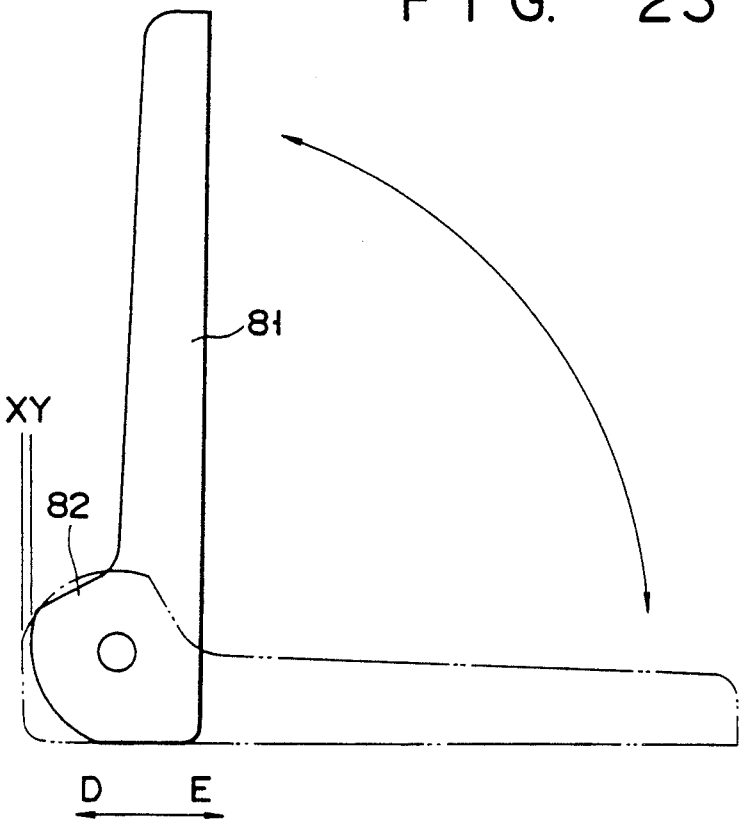
FIG. 24 is a side view illustrating how the operating lever of the coupling device operates.
Figure 25:
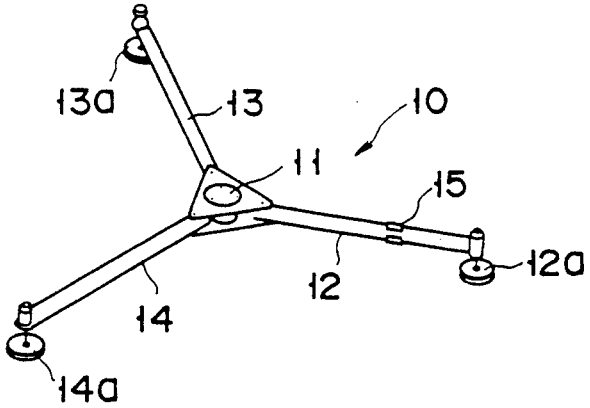
FIGS. 25 through 29 are perspective views illustrating the assembling and disassembling operations relating to the antenna apparatus.

When cam lever 81 is rotated clockwise from the raised state, the above-mentioned end portion of cam surface 82 moves and takes first position X, as is shown in FIG. 24. In response to this movement, second coupling member 79 is moved in direction D through the action of two washers 83 and 85, in spite of the spring force of springs 84. As a result, first and second coupling members 78 and 79 are positioned and fastened together by means of coupling rod 80 and springs 84. In this fashion, first to sixth divisions 71–76 are coupled together, to thereby fabricate reflector 70.

To divide reflector 70 into first to sixth divisions 71–76, cam lever 81 is rotated counterclockwise, thereby causing the above-mentioned end portion of cam surface 82 to take second position Y. As a result, the spring force of springs 84 is reduced. Since first and second coupling members 78 and 79 are released from the fastened condition, the members of coupling mechanism 77 are disassembled in the order reverse to that in which they are assembled. Accordingly, reflector 70 is divided into first to sixth divisions 71–76.

The constructions of leg unit 10, support unit 30, arm unit 50, reflector 70 and primary horn 90 were described above, and a description will now be given as to how these components are assembled into an antenna apparatus and how the antenna apparatus is disassembled back into the components.

Figure 26:
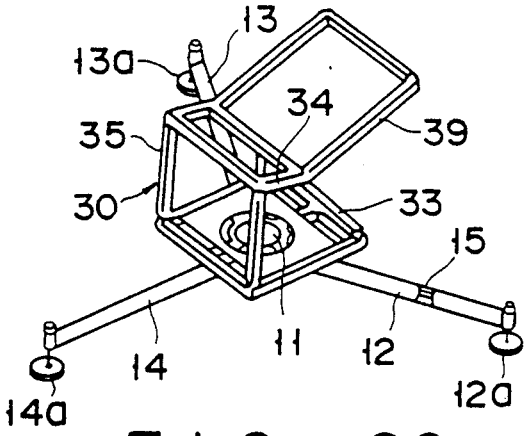
Figure 27:
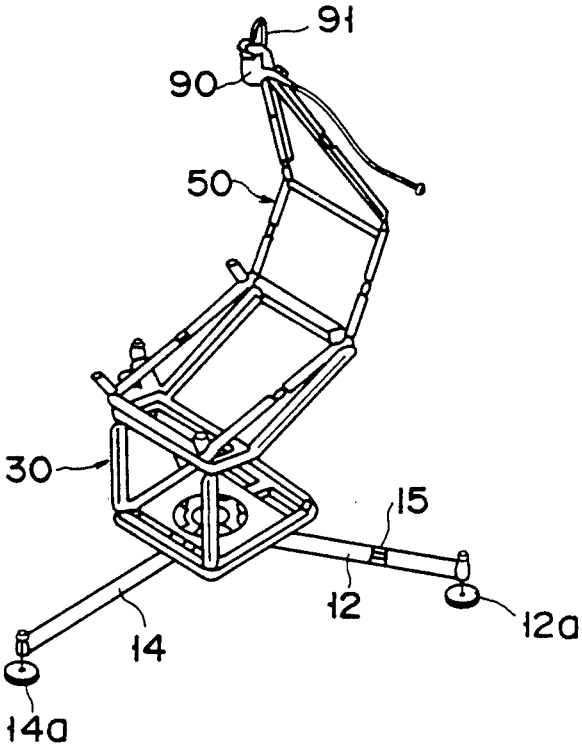
Figure 28:
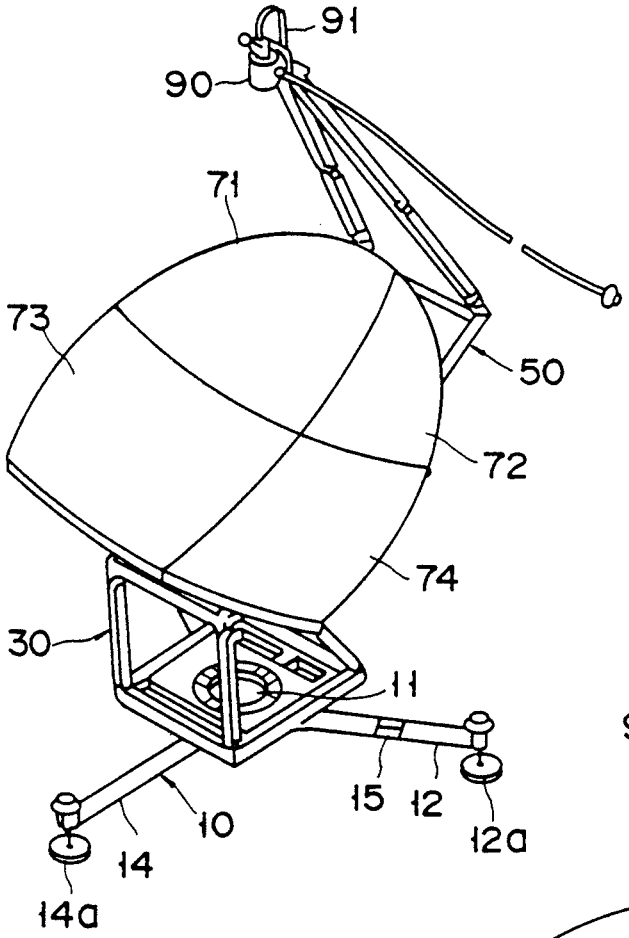
Figure 29:
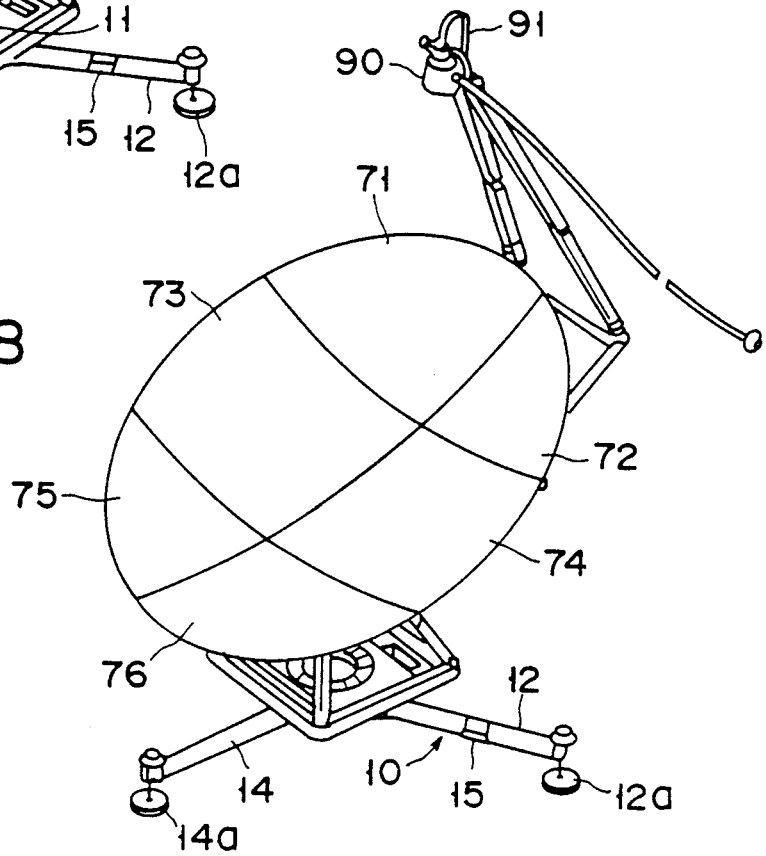

First of all, first to third legs 12–14 of leg unit 10 are expanded and are installed at a predetermined location. Support unit 30, which is expanded beforehand, is coupled to mount 11*a* of leg unit 10, as is shown in FIG. 26. Prior to this coupling operation, jack 40 of support unit 30 is adjusted by use of standard scale 41 (which is shown in FIG. 9 and is generally referred to as an EL scale), for the coarse adjustment of the angle at which jack 40 is held (see FIG. 10). After support unit 30 is coupled to mount 11*a*, jacks 12*a*–14*a* of legs 12–14 are adjusted to be substantially at the same level. Succeedingly, arm unit 50, which is expanded beforehand, is coupled to support unit 30 (see FIG. 27). Primary horn 90 is attached to primary radiator mount 57 of arm unit 50, and wave guide 91 connected to a transmitting-/receiving device (not shown) is attached to primary horn 90, as is shown in FIG. 27. Next, first to fourth divisions 71–74, which are coupled together beforehand by means of coupling mechanism 77, are attached to holder 53 of reflector-mounting member 51, as is shown in FIG. 28. After this, fifth and sixth divisions 75 and 76 are coupled to second and third divisions 73 and 74, as is shown in FIG. 29. Finally, jacks 12*a*–14*a* of legs 12–14 of leg unit 10 are adjusted, for the fine adjustment of the level, and the elevation angle of reflector 70 is finely adjusted by operating jack 40 of support unit 30.

The portable antenna apparatus of the present invention is made up of leg unit 10, support unit 30, arm unit 50, reflector 70, and primary horn 90. Leg unit 30 is provided with first to third legs 12–14 which can be folded or expanded and include jacks 12*a*–14*a*, respectively. Support unit 30, including jack 40, can be folded or expanded and is detachably coupled to mount 11*a* of leg unit 10. The angle of rotation of mount 11*a* is freely adjustable. Arm unit 50 is provided with: reflector-mounting member 51 which can be lengthened or shortened and is attached to support unit; and primary horn mount 57 which is put on reflector-mounting portion 51 when folded. Reflector 70 is provided with first to sixth divisions 71–76 detachably attached to holder 53 of arm unit 50. Primary horn 90 is coupled to primary horn mount 57 of support unit 50.

With the above construction, the number of packages required when the antenna apparatus is disassembled for keeping can be reduced to the minimum, and the size and weight of each disassembled part satisfy the International Flight Package Standard. In addition, the handling of the antenna apparatus, including the assembling and disassembling operations, is very easy. When the antenna apparatus is fabricated for use, the direction in which reflector 70 is placed is adjusted at mount 11*a* of leg unit 10, and the elevation angle of reflector 70 is adjusted by means of jack 40 of support unit 30, whereby the reflector can be made to meet the various antenna standards, including the U.S. FCC Standard.

In the antenna apparatus of the present invention, first to sixth divisions 71–76 of reflector 70 can be coupled together or divided from one another by operating cam lever 81 alone. Therefore, the assembling and disassembling operations are very easy to perform.

In the antenna apparatus of the present invention, the elevation angle of reflector 70 is adjustable within the range of 5° to 80° by means of jack 40. Therefore, the signal transmission and reception with respect to a communication satellite are enabled all over the world.

The above embodiment was explained, referring to the case where reflector 70 is made up of sixth divisions 71–76. However, the number of divisions of reflector 70 is not limited to this; it can be determined freely in accordance with the need.

In addition, the urging means attached to coupling rod 80 of the reflector coupling mechanism need not be limited to initially coned disk springs 84; various types of spring members may be used in place of springs 84. Further, the engaging member attached to the tip end of coupling rod 80 is not limited to nut 86; a member of any type may be used as long as it can engage the tip end of coupling rod 80.

When the leg unit of the antenna apparatus is expanded, first leg 12 is lengthened until it becomes as long as second and third legs 13 and 14. When the leg unit is folded, first leg 12 is shortened such that jacks 21a–14a are aligned for keeping. Therefore, the leg unit can reliably support a large and heavy object when it is expanded, and can be made small enough to meet the International Flight Package Standard when it is folded. If the length of first leg 12 is fixed, the sum of the length, width and height of the folded leg unit will be 2390 mm. Since first leg 12 can be shortened, the value of that sum can be reduced to 1850 mm in the case of the present invention.

In the above-mentioned embodiment, the leg unit was described as having one fixed leg and two pivotally-connected legs. However, the number of pivotally connected legs may be three or more.

Needless to say, the present invention is not limited to the above-mentioned embodiment. It can be modified in various manners without departing from the spirit of the invention.

What is claimed is:

1. A portable antenna apparatus, comprising:

a foldable leg unit including at least three legs each having a first jack, and a mount;

a foldable support unit coupled to the mount and including a plurality of beam members;

a foldable arm unit coupled to the support unit and including a reflector mounting member with extending means, an arm hinging at the reflector mounting member, and a primary horn mount attached to the arm;

a reflector supported on the reflector mounting member of the arm unit and including a plurality of divisions; and a primary horn attached to the primary horn mount of the arm unit, said support unit including a base member, and a second jack having a first end attached to the base member, said base member and said beam members being hinged together in a manner to provide a substantially box-like shape, and said second jack having a second end hinged to one of the beam members so as to allow an elevation angle of the reflector to be adjusted within a range of 5° to 80°.

2. A portable antenna apparatus according to claim 1, wherein said leg unit and said support unit are detachably coupled together, and said support unit and said arm unit are detachably coupled together.

3. A portable antenna apparatus according to claim 1, wherein said divisions of the reflector are coupled together by coupling means having a lever.

4. A portable antenna apparatus according to claim 1, wherein said reflector is ellipsoidal.

5. A portable antenna apparatus according to claim 4, wherein said ellipsoidal reflector is divisible into six divisions along the longer axis of the ellipsoidal reflector and along two lines perpendicular to the longer axis and dividing the longer axis into three substantially equal line segments.

6. A portable antenna apparatus according to claim 1, wherein:

said reflector includes at least first and second divisions, and reflector coupling means for coupling said at least first and second divisions together; and said reflector coupling means comprises:

a first coupling member attached to the first division and having a fitting hole;

a locking member which is slidable in a manner to cover the fitting hole of the first coupling member;

a second coupling member attached to the second division and having a projection which has an insertion hole and is engageable with the fitting hole of the first coupling member;

a coupling rod inserted into both the fitting hole of the first coupling member and the insertion hole of the second coupling member;

an engaging member, attached to a distal end of the coupling rod, for stopping the locking member;

an operating lever attached to a proximal end portion of the coupling rod and having a cam surface, part of said cam surface being movable between first and second positions shifted in an axial direction of the coupling rod; and urging means for pressing the first and second divisions against each other when the part of the cam surface takes the first position, and for releasing the first and second divisions when the part of the cam surface takes the second position.

7. A portable antenna apparatus according to claim 1, wherein said leg unit includes a main body and a plurality of legs, one of the legs being fixed to the main body, and the other legs being pivotally coupled to the main body so as to deploy on a horizontal plane through the main body.

8. A portable antenna apparatus according to claim 7, wherein said leg fixed to the main body includes an extension mechanism for permitting said leg to be lengthened or shortened in accordance with a deployed or folded condition of the other legs.

9. A portable antenna apparatus, comprising:

a foldable leg unit including at least three legs each having a first jack, and a mount;

a foldable support unit coupled to the mount and including a plurality of beam members;

a foldable arm unit coupled to the support unit and including a reflector mounting member with extending means, an arm hinging at the reflector mounting member, and a primary horn mount attached to the arm;

an ellipsoidal reflector supported on the reflector mounting member of the arm unit and including a plurality of divisions; and a primary horn attached to the primary horn mount of the arm unit;

said ellipsoidal reflector being divisible into six divisions along the longer axis of the ellipsoidal reflector and along two lines perpendicular to the longer axis and dividing the longer axis into three substantially equal line segments.

10. A portable antenna apparatus, comprising:

a foldable leg unit including at least three legs each having a first jack, and a mount;

a foldable support unit coupled to the mount and including a plurality of beam members;

a foldable arm unit coupled to the support unit and including a reflector mounting member with extending means, an arm hinging at the reflector mounting member, and a primary horn mount attached to the arm;

a reflector supported on the reflector mounting member of the arm unit and including a plurality of divisions; and a primary horn attached to the primary horn mount of the arm unit, said reflector including at least first and second divisions, and reflector coupling means for coupling said at least first and second divisions together; and said reflector coupling means comprising:

a first coupling member attached to the first division and having a fitting hole;

a locking member which is slidable in a manner to cover the fitting hole of the first coupling member;

a second coupling member attached to the second division and having a projection which has an insertion hole and is engageable with the fitting hole of the first coupling member;

a coupling rod inserted into both the fitting hole of the first coupling member and the insertion hole of the second coupling member;

an engaging member, attached to a distal end of the coupling rod, for stopping the locking member;

an operating lever attached to a proximal end portion of the coupling rod and having a cam surface, part of said cam surface being movable between first and second positions shifted in an axial direction of the coupling rod; and urging means for pressing the first and second divisions against each other when the part of the cam surface takes the first position, and for releasing the first and second divisions when the part of the cam surface takes the second position.

11. A portable antenna apparatus, comprising:

a foldable leg unit including at least three legs each having a first jack, and a mount;

a foldable support unit coupled to the mount and including a plurality of beam members;

a foldable arm unit coupled to the support unit and including a reflector mounting member with extending means, an arm hinging at the reflector mounting member, and a primary horn mount attached to the arm;

a reflector supported on the reflector mounting member of the arm unit and including a plurality of divisions; and a primary horn attached to the primary horn mount of the arm unit, said leg unit including a main body and a plurality of legs, one of the legs being fixed to the main body, and the other legs being pivotally coupled to the main body so as to deploy on a horizontal plane through the main body.

12. A portable antenna apparatus according to claim 11, wherein said leg fixed to the main body includes an extension mechanism for permitting said leg to be lengthened or shortened in accordance with a deployed or folded condition of the other legs.

* * * * *